US006021837A

United States Patent [19]

Miller

[11] Patent Number: 6,021,837

[45] Date of Patent: Feb. 8, 2000

[54] SHUTTER TRACKS FOR ROLLING PROTECTIVE SHUTTERS

[76] Inventor: James V. Miller, 893 Maryknoll Cir., Glen Ellyn, Ill. 60137

[21] Appl. No.: 09/008,621

[22] Filed: Jan. 16, 1998

[51] Int. Cl.[7] ..... E06B 9/15

[52] U.S. Cl. ..... 160/133; 160/271

[58] Field of Search ..... 160/133, 32, 33, 160/290.1, 310, 271, 272, 273.1, 327, 328, 391, 392

[56] References Cited

U.S. PATENT DOCUMENTS

| | | | |
|---|---|---|---|
| 845,526 | 2/1907 | Collins . | |
| 3,430,677 | 3/1969 | Pierce | 160/264 |
| 4,037,639 | 7/1977 | Jones | 160/133 |
| 4,201,359 | 5/1980 | Baslow | 160/392 X |
| 4,234,033 | 11/1980 | Leivenzon et al. | 160/133 |
| 4,294,302 | 10/1981 | Ricke, Sr. | 160/133 |
| 4,343,340 | 8/1982 | Paule | 160/235 X |
| 4,345,635 | 8/1982 | Solomon | 160/133 |
| 4,493,356 | 1/1985 | Hermann et al. | 160/133 |
| 4,799,525 | 1/1989 | Seymour | 160/133 |
| 4,807,687 | 2/1989 | Finch et al. | 160/133 |
| 4,920,714 | 5/1990 | Sease | 160/392 X |
| 4,929,862 | 5/1990 | Hamilton et al. | 312/138.1 |
| 4,986,332 | 1/1991 | Lanuza | 160/327 |
| 5,172,744 | 12/1992 | Finch et al. | 160/133 |
| 5,365,990 | 11/1994 | Ueda | 160/23.1 |
| 5,469,905 | 11/1995 | McKinney et al. | 160/35 |
| 5,575,322 | 11/1996 | Miller | 160/133 |
| 5,586,592 | 12/1996 | McGregor | 160/133 |
| 5,601,130 | 2/1997 | Werner et al. | 160/183 |
| 5,657,805 | 8/1997 | Magro | 160/133 |

FOREIGN PATENT DOCUMENTS

| | | |
|---|---|---|
| 0 092 122 | 10/1983 | European Pat. Off. . |
| 0 212 476 | 3/1987 | European Pat. Off. . |
| 225170 | 8/1910 | Germany . |
| 2 015 916 | 10/1971 | Germany . |
| 27 05 119 | 8/1978 | Germany . |
| 27 28 440 | 1/1979 | Germany . |

OTHER PUBLICATIONS

Communication Relating to the Results of the Partial International Search, International Application No. PCT/US99/00793, mailed May 14, 1999.

English–language abstract of German–language publication 27 05 119 (Item B1).

ALULUX, "The Anti–Push–Up Lock for ALL Alulux Roller Shutters," 1 page.

Sweet's General Building & Renovation 1997 Catalog File, atlas™, 1997 Product Guide, 08330/ATL, BuyLine 0371, pp. 1–23.

Sweet's General Building & Renovation 1997 Catalog File, Cornell Iron Works, "Rolling Doors and Grilles," 08330/COR, BuyLine 0058, pp. 1–24.

IMBAC, "Synoptical Tables, Rolling Shutters," two diagrams, one page.

Sweet's General Building & Renovation 1997 Catalog File, JF® DYNAFLAIR, "Security—With a Flair," 08330DYL, BuyLine 5327, pp. 1–12.

(List continued on next page.)

*Primary Examiner*—David M. Purol

*Attorney, Agent, or Firm*—Marshall, O'Toole, Gerstein, Murray & Borun

[57] ABSTRACT

The present invention is directed to a rolling protective shutter having improved shutter tracks. The improved shutter tracks according to the present invention include an improved stopping mechanism that prevents the shutter from completely rolling up onto the shutter support member, provides for adjustment of the position where the shutter will stop as the shutter is rolled up onto the shutter support member, and is hidden within the shutter tracks. The improved shutter tracks according to the present invention further include an improved cover assembly for use in concealing angle brackets and the associated attachment hardware when a shutter track is angle mounted to a wall or jamb. The cover assembly completely encloses the angle bracket to give the shutter track and, consequently, the rolling protective shutter a finished appearance after installation.

12 Claims, 5 Drawing Sheets

OTHER PUBLICATIONS

Sweet's General Building & Renovation 1997 Catalog File, JG Wilson, "Coiling Doors, Grilles, Fire Doors," 08330/MCK, BuyLine 6566, pp. 1–16.

LAKAL Rolladensysteme, "LAKAL Profil AHS 75," "LAKAL Rollgitter," "LAKAL Blendkappen 254 RS und 304 RS," "Sicherheits–Führungsschiene," 4 pages.

Sweet's General Building & Renovation 1997 Catalog File, R & S, "Rolling Door Products," 08330/RSM, BuyLine 7130, pp. 1–14.

Sweet's General Building & Renovation 1997 Catalog File, Raynor, "Rolling Doors & Electric Operators," 08330/RAY, BuyLine 3491, pp. 1–36.

Sweet's General Building & Renovation 1993 Catalog File, Rolladen®, Rolladen® Rollshutters, B499, 08667/ROL, BuyLine 6493, pp. 1–8, 1993.

Sweet's General Building & Renovation 1996 Catalog File, Rolladen®, Rolladen® Rollshutters, B499, 08667/ROL, BuyLine 6493, pp. 1–8, 1996.

SIRO, Safety Roller Blinds, "Safety roller blind Type Sd," Safety roller blind Type Se 2 mm and Type Se 3 mm, Safety roller blinds, 4 pages.

Sweet's General Building & Renovation 1993 Catalog File, Solaroll® Shade & Shutter Corporation, Catalog 561, B505, 08667/SOL/ BuyLine 1828, pp. 1–40.

SHUTTER TRACKS FOR ROLLING PROTECTIVE SHUTTERS

BACKGROUND OF THE INVENTION

The present invention is directed to a rolling protective shutter assembly which has a protective shutter, for covering a window or door opening, that may be rolled up into a shutter housing when not in use.

Rolling protective shutters are conventional and are used to provide protection against extreme weather conditions and to deter theft, for example. One such rolling protective shutter is disclosed in U.S. Pat. No. 4,345,635 to Solomon. As shown in FIGS. 1 and 2 of that patent, the Solomon shutter is composed of a plurality of elongate slats, each of which has a pair of circular ribs attached to its sides. The slats are interconnected by a plurality of elongate hinges, each of which has a pair of circular apertures in which the circular ribs of the slats are disposed. When the Solomon shutter is unrolled to its protective position, each of the slats in the shutter is disposed vertically with the ends of the slats disposed with guide channels or side tracks on either side of the opening. When not in use, the Solomon shutter may be rolled up into a housing disposed at the upper end of the protective shutter.

Another type of rolling protective shutter is disclosed in U.S. Pat. No. 5,365,990 to Ueda. As shown in FIGS. 2 and 3 of that patent, the Ueda shutter is composed of a plurality of slats, each of which has an upper rearward hook extending longitudinally along the upper edge of the slat and a lower U-shaped recess extending longitudinally along the lower edge of the slat. The recess has a forward horizontal projection on a rear edge and extending longitudinally so that when the lower slat moves down under gravity, the hook of the lower slat bears on the horizontal projection of the upper slat. The Ueda shutter may be rolled up and unrolled in a similar manner as the Solomon shutter.

In rolling shutter systems such as the Solomon and Ueda shutters, a portion of the shutter must remain within the side tracks to prevent the shutter from completely rolling up onto the take-up roll within the shutter housing. In some applications, the bottommost slat has a handle extending outwardly from the shutter. One way to stop the bottom of the shutter from entering the housing is to size the opening in the housing through which the shutter passes narrow enough so that the handle hits the housing. The bottom of the shutter will stop short of entering the housing, but in many installations the housing is fabricated from sheet metal that is easily bent if the shutter is rolled up too rapidly.

In another alternative for stopping the bottom of the shutter, metal braces are attached to the side tracks and extend inwardly into the opening so that they engage the handle as the shutter is rolled up. Although the braces are stronger than the sheet metal housing, the handle and the braces can be damaged from repeated metal-on-metal impacts. Both the handle and the braces can be bent, gouged or broken, thereby increasing the possibility that the entire shutter will roll up into the housing and causing deterioration of the appearance of the shutter system. Additionally, the shutter may make a loud bang when the metal handle impacts the metal braces. Therefore, there is a need for a better stopping mechanism that is reliable, adjustable and will preserve the appearance of the shutter system.

The most common mounting application for shutter systems is a surface mount for the housing and shutter tracks on either the inside or the outside of the opening. In other mounting applications, the housing and side tracks are mounted between the walls or jambs that define the opening. In these applications, a recess mount may be used wherein the ends of the side tracks are mounted directly to the walls or jambs. However, if the walls or jambs are not plumb and flat, or if the dimensions of the opening are even slightly off, the side tracks may not mount flush against the wall or jamb, the shutter may get bound up in the tracks or, alternatively, come out of the tracks, or the shutter system may not fit within the opening.

In an alternative to recess mounts, angle mounts are used wherein L-shaped angle brackets are used to mount the side tracks to the walls or jambs. When angle mounts are used, the measurements are not as critical because the angle bracket acts as a trim spacer that hides the space between the side track and the wall or jamb. One drawback to the angle mounts versus the recess mounts is that the heads of the fasteners used to attach the angle brackets are visible. Visible fastener heads may be acceptable for shutter systems mounted to building exteriors, but they may not be desired in interior applications. Therefore, a need exists for a cover for the angle brackets that hides the heads of the fasteners and provides a finished appearance to the angle mounted shutter system.

SUMMARY OF THE INVENTION

The present invention is directed to a rolling protective shutter having improved shutter tracks. The improved shutter tracks according to the present invention include an improved stopping mechanism that prevents the shutter from completely rolling up onto the shutter support member, provides for adjustment of the position where the shutter will stop as the shutter is rolled up onto the shutter support member, and is hidden sithin the shutter tracks. The improved shutter tracks according to the present invention further include an improved cover assembly for use in concealing angle brackets and the associated attachment hardware when a shutter track is angle mounted to a wall or jamb. The cover assembly substantially completely encloses the angle bracket to give the shutter track and, consequently, the rolling protective shutter a finished appearance after installation.

According to one aspect of the present invention, a rolling shutter assembly includes a shutter coupled to a shutter support member. The shutter includes a plurality of individual slats and a plurality of hinges interconnecting the slats, with one of the slats having an engagement member extending outwardly from one end. The rolling shutter assembly further includes a pair of shutter tracks and a stop member disposed within the shutter track associated with the end of the one slat having the engagement member extending therefrom. The stop member is disposed within the shutter track in a position proximate the shutter support member.

The shutter and the shutter support member are adapted to roll the shutter from an unrolled position in which the slats are disposed within the shutter tracks to a rolled position in which the shutter is rolled up on the shutter member. The stop member is adapted to engage the engagement member to prevent the one of the slats with the engagement member from rolling onto the shutter support member when the shutter is rolled from the unrolled position toward the rolled position. The shutter stops at a stop position when the engagement member is engaged by the stop member, and the shutter may be rolled within the shutter tracks between the unrolled position and the stop position.

The engagement member may be slidably disposed within the one of the slats between an extended position and a retracted position. In the extended position, the stop member engages the engagement member to stop the shutter in the stop position. In the retracted position, the engagement member is disposed within the one of the slats, thereby permitting the one of the slats and, consequently, the entire shutter to roll up onto the shutter support member. In an alternative embodiment, the one of the slats includes a pair of engagement members that extend outwardly from either end of the one of the slats, and each of the shutter tracks has a stop member disposed therein to engage the corresponding engagement member to stop the shutter at the stop position.

In another alternative embodiment, the stop member includes a rigid member having an adjustment mechanism with a locked position and an unlocked position. In the locked position, the rigid member is retentively held in place by the adjustment mechanism. In the unlocked position, the rigid member is slidable within the shutter track to facilitate adjustment of the stop position.

In another aspect of the present invention, a cover assembly is provided for use with a bracket used to mount a shutter track of a rolling shutter assembly to a wall that defines a side of an opening. The cover assembly includes a base member mounted to the bracket and having a first coupling member that extends outwardly from the base member and away from the bracket. The cover assembly further includes a cover member having a second coupling member extending outwardly from a first surface of the cover member. The second member is adapted to demountably couple the cover member to the base when the second coupling member is engaged by the first coupling member. The cover member is adapted to substantially enclose the bracket and the base member within the wall, the shutter track, and the cover member when the second coupling member is engaged by the first coupling member. Alternatively, the base member may be integrally formed with either the cover member or the bracket. Moreover, the base member may be mounted to the bracket using either the same fasteners used to fasten the bracket to the wall and shutter track, different fasteners, of an adhesive substance.

The features and advantages of the invention will be apparent to those of ordinary skill in the art in view of the detailed description of the preferred embodiments, which is made with reference to the drawings, a brief description of which is provided below.

DETAILED DESCRIPTION OF THE PREFERRED EMBODIMENTS

Figure 1:
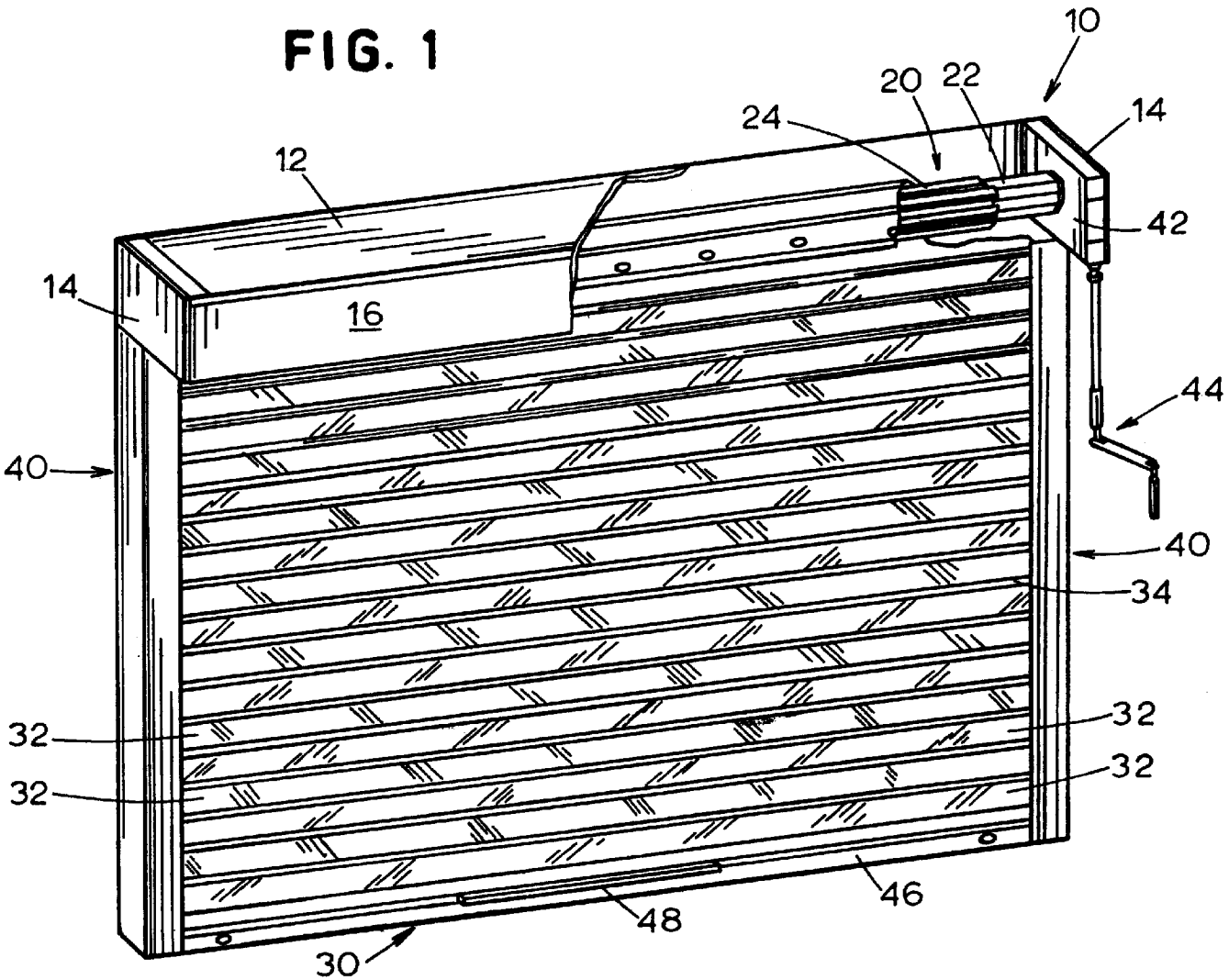
FIG. 1 is a perspective view of a rolling shutter assembly that can implement the present invention.
Figure 2:
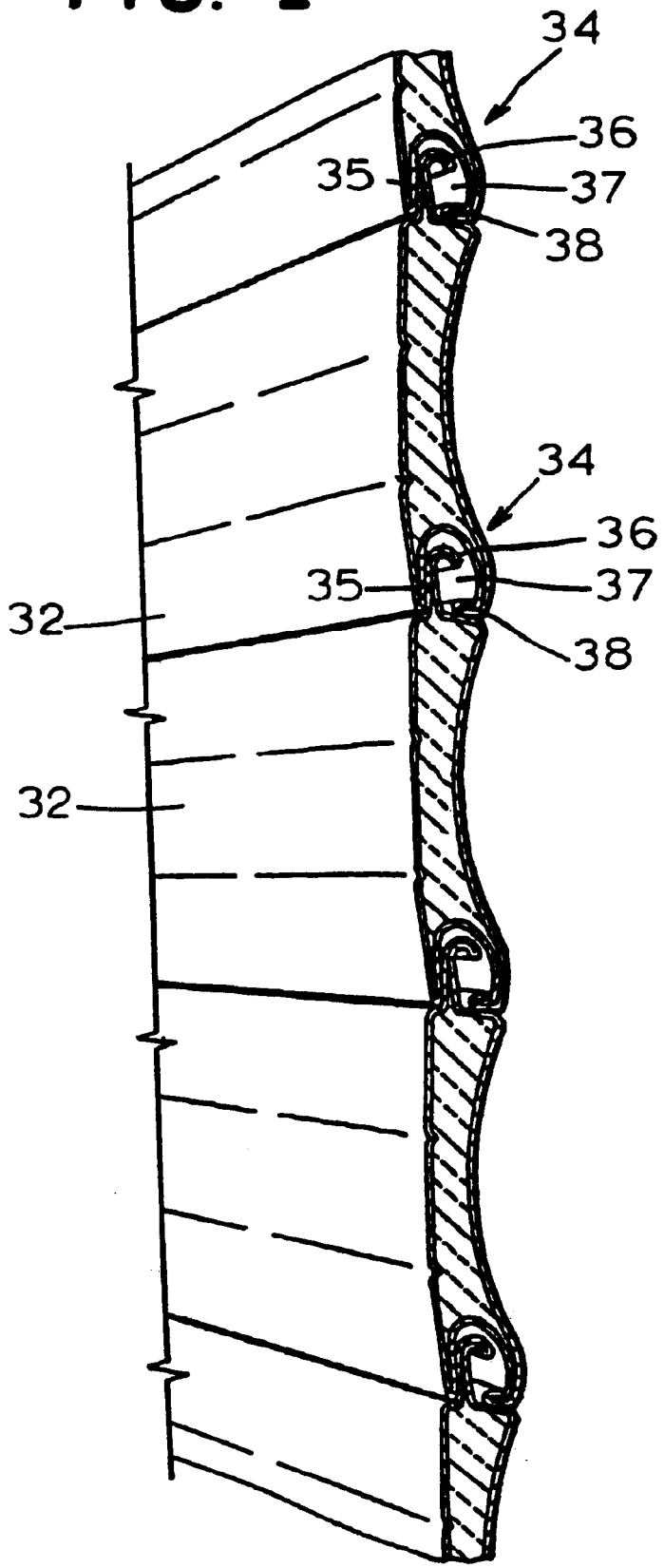
FIG. 2 is a fragmentary perspective view of a portion of the shutter of the shutter assembly of FIG. 1.
Figure 3:
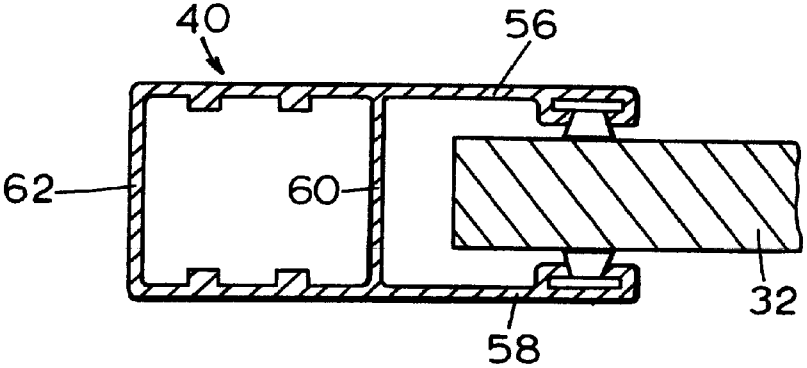
FIG. 3 is a cross-sectional top view of a portion of the shutter assembly of FIG. 1.

One type of a rolling shutter assembly 10 that may implement the present invention is shown in FIGS. 1–3. Referring to FIG. 1, the shutter assembly 10 has a shutter housing which includes a top wall 12, a pair of side walls 14, and a front wall 16. A shutter support member 20 is mounted for rotation within the shutter housing. The support member 20 includes a generally cylindrical central shaft 22 and a plurality of mounting members 24 fixed to the shaft 22.

The upper end of a rolling shutter 30 is coupled to the mounting members 24. The shutter 30 is composed of a plurality of individual, elongate slats 32. One example of a configuration of slats 32 is illustrated in FIG. 2. The slats 32, each of which is substantially flat, having two substantially planar side portions, and may be composed of steel, are interconnected by a plurality of hinges 34, each of which joins together a pair of adjacent slats 32. Each of the slats 32 includes an upward projection 35 extending longitudinally along the upper edge of the slat 32 and having a rearwardly and downwardly extending hook 36 at the top. Each of the slats 32 further includes a downward facing U-shaped recess 37 extending longitudinally along the lower edge of the slat 32 and having a forward horizontal projection 38 formed on the rear edge of the recess 37. The hook 36 of a lower slat 32 and the recess 37 and projection 38 of an upper slat 32 interlock to form each hinge 34. Other configurations of slats 32 and interconnecting hinges 34, such as the configuration of the Solomon shutters, are well known in the art and are contemplated by the inventor as having use with the present invention.

Referring back to FIG. 1, the ends of the slats 32 are disposed within a pair of shutter tracks 40. The shutter assembly 10 has a gearbox 42 which interconnects the rotatable shaft 22 with a hand crank 44 via a conventional gear assembly (not shown). When mounted to protect a window or other opening, the shutter tracks 40 of the shutter assembly 10 are positioned on either side of the opening and the shutter housing is positioned over the top of the opening. Alternatively, in some applications, the side tracks 40 and shutter housing are positioned within the opening. When the shutter 30 is not in use, it is rolled up on the shutter support member 20 via the hand crank 44 so that it is at least partially enclosed by the shutter housing. The hand crank 44 may be disposed on a rear portion of the shutter assembly 10 so that the shutter 30, when attached over a window for example, can be unrolled from inside the window. Alternatively, when the gearbox 42 is not provided, the support member 20 may include a torsion spring. The shutter 30 may be rolled and unrolled with the assistance of the tension in the spring by exerting a force on a bottommost slat 46 by grasping a handle 48 that extends longitudinally along the slat 46 and outwardly from the shutter 30. Other drive mechanism, such as straps and tubular operators are well known to those of ordinary art and are contemplated by the inventor as having use with the present invention.

The structure of one example of previously known shutter tracks 40 is illustrated in FIG. 3, which is a horizontal cross-section of one of the shutter tracks 40. Each shutter track 40 is composed of a pair of side walls 56, 58 joined by an end wall 60. A structural support member 62 is disposed on the outside of the end wall 60 to provide additional structural support to the shutter track 40, and to receive a support member (not shown), commonly referred to as a nipple, that extends downwardly from the side wall 14 of the housing to secure the housing to the side track 40. In this configuration, the side walls 56, 58 and the end wall 60 define a first channel that receives the shutter 30, and the end wall 60 and the structural support member 62 define a second channel that receives the nipple when the housing is connected to the side track 40.

During the assembly of the protective shutters 10 described above, the shutters 30 are formed by sliding the hooks 36 of the lower slats 32 into the U-shaped recesses 37 of the upper slats 32. After the shutter 30 is assembled in that fashion, it is disposed between the side tracks 40, which prevent the hooks 36 from sliding out of the U-shaped recesses 37.

Although the slats described above are substantially flat, they could be provided with a curved shape to facilitate rolling up of the shutter. Other drive mechanisms for rolling the shutter up may also be used. For example, instead of having a hand crank fixed to a gearbox, the drive mechanism may comprise an electric motor directly coupled to the shaft on which the shutter rolls up. Instead of being integrally formed with the shutter slats, the hooks and U-shaped recesses described above could be separate components connected thereto, such as by bolting or riveting. Instead of hooks and recesses, other locking members having different structures could be used to form the hinges.

Figure 5:
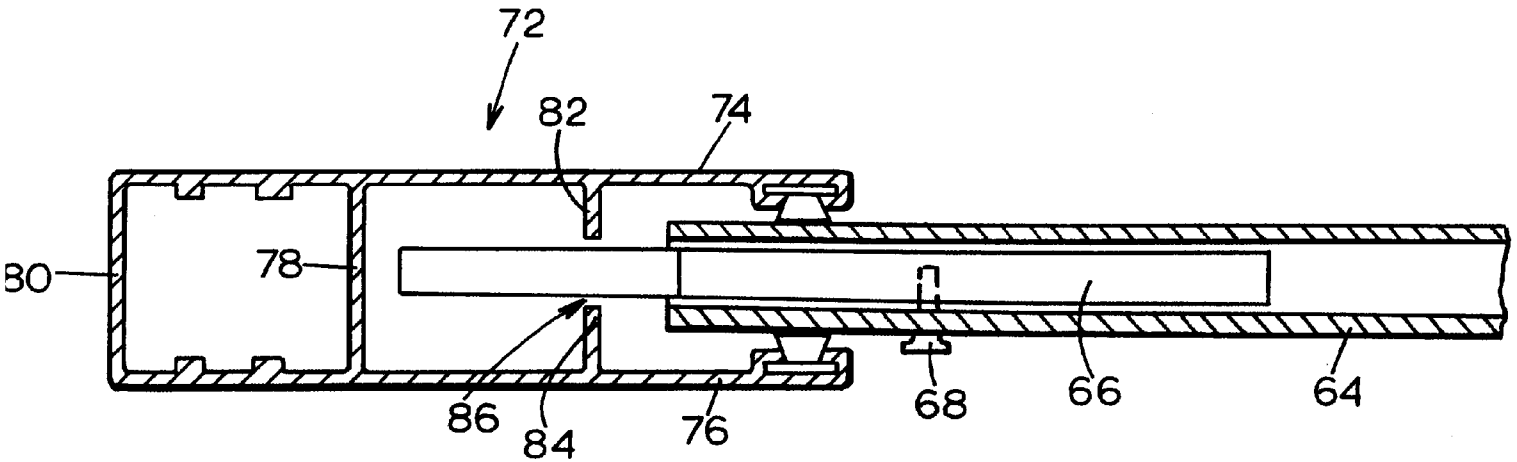
FIG. 5 is a cross-sectional top view of a portion of the shutter assembly of FIG. 4 taken along line 5—5.
Figure 4:
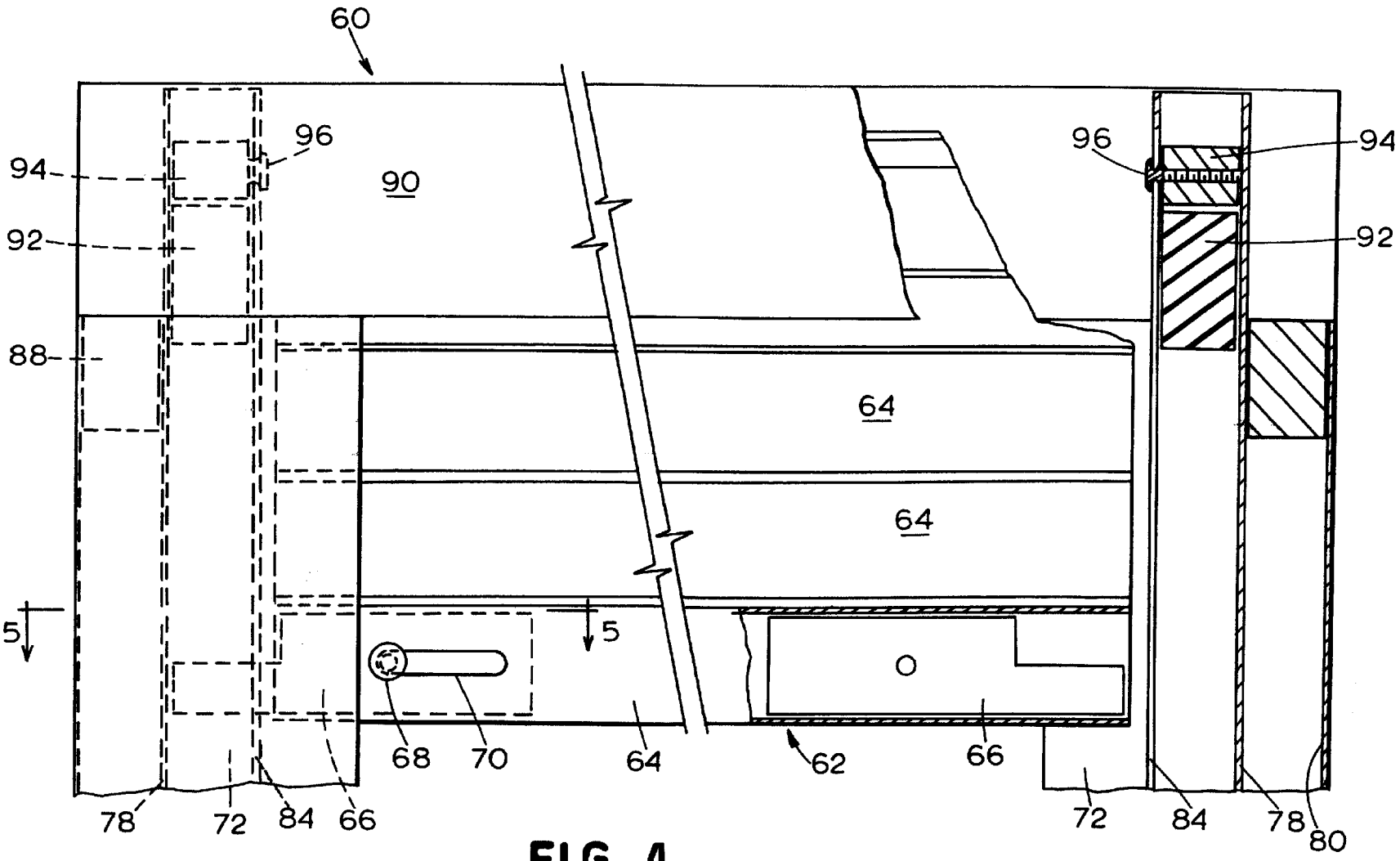
FIG. 4 is a partial cross-sectional front view of a portion of a shutter assembly implementing a stopping mechanism according to the present invention.

As previously discussed, a portion of the shutter 30 must remain outside the shutter housing and within the side tracks 40 when the shutter 30 is rolled up. Previously, the shutter 30 was stopped using a visible, external mechanism via a metal-to-metal impact of a part of the shutter 30, such as the handle 48 on the bottommost slat 46, and either a part of the housing or members extending inwardly from the side tracks 40. Repeated impacts of the components of the protective shutter 10 can cause damage the components and generally degrade the appearance of the protective shutter 10. An improved hidden mechanism for stopping the shutter 30 according to the present invention is illustrated in FIGS. 4 and 5.

The improved stopping mechanism according to the present invention utilizes retractable arms on the ends of one of the slats to engage rubber stops disposed within the side tracks proximate the housing. Referring to FIG. 4, which is a partial cross-section, a portion of a protective shutter 60 implementing the stopping mechanism is illustrated. The protective shutter 60 includes a rolling shutter 62 composed of a plurality of slats 64. The bottommost slat 64 has a pair of retractable arms 66 disposed therein at either end and slidable within the slat 64 between an extended position, as shown for the arm 66 on the left, and a retracted position, as shown for the arm 66 on the right. In the illustrated embodiment, the arms 66 are secured in the extended and retracted positions by set screws 68 that are slidable within slots 70 on the surface of the slat 64.

The protective shutters 60 further include side tracks 72 that are adapted to receive the extended arms 66 and allow the shutter 62 to be rolled up and unrolled. The structure of the side tracks 72 is illustrated in FIG. 5, which is a horizontal cross-section of the left side track 72. Each side track 72 has the same general configuration as the side tracks 40 described above, with a pair of side walls 74, 76, and end wall 78, and a structural support member 80. The side track 72 further includes a pair of fins 82, 84 that extend inwardly from the side walls 74, 76, respectively, and define a gap 86 wide enough to receive the extended arm 66. Configured in this way, the side tracks 72 provide three separate channels. The fins 82, 84 and portions of the side walls 74, 76 define a first channel adapted to receive the slats 64 when the shutter 62 is unrolled. The end wall 78 and the structural support member 80 define a second channel that receives a nipple 88 extending downwardly from the housing 90 when the protective shutter 60 is assembled, as shown in FIG. 4.

The stopping mechanism further includes a rubber stop 92 disposed within a third channel defined by the end wall 78, the fins 82, 84, and the portions of the side walls 74, 76 between the end wall 78 and the fins 82, 84. The rubber stop 92 is frictionally engaged by the walls 74, 76, 78 and fins 82, 84 with sufficient force to hold the stop 92 in place with the third channel against gravity, and is slidable with the third channel when an additional force is exerted to reposition the stop 92.

The shutter tracks 72 according to the present invention provide additional structural support for the housing 90 of the protective shutter 60. Because the first channel receives the shutter 62 and the second channel receives the nipple 88, the first and second channels terminate proximate the bottom of the housing 90. Conversely, the third channel extends upwardly into the housing 90 and terminates proximate the top of the housing 90. Arranged in this way, the rear of the housing 90 may be mounted directly to the side tracks 72. This arrangement provides a significant advantage over previous protective shutters wherein the nipples provided the only structural connection between the housing and the side tracks and were susceptible to cracking or breaking off under the weight of the housing.

The stopping mechanism further includes a positioning block 94 disposed within the third channel above the rubber stop 92. The positioning block 94 includes a set screw 96 that may be tightened to hold the block 94 in place in the third channel and untightened to allow the block 94 to slide up and down within the third channel. By sliding the block 94 up or down, the stopping point of the shutter 62 is adjusted to the desired height. In an alternative embodiment of the present invention, the block 94 may be omitted and rubber stop 92 may be held in place in the side track 72 by having the upper end of the stop 92 engage the top of the housing 90. In this embodiment, the stopping position of the shutter 62 may be adjusted using stops 92 of different lengths. In another alternative embodiment, the rubber stop 92 may be omitted so that the positioning block 94 alone is used to stop the shutter 62. Other alternative arrangements for positioning a stop member within the third channel of the side track 72 will be obvious those of ordinary skill in the art.

When the arms 66 are in the retracted position, each arm 66 is disposed within the slat 64. In this position, the stopping mechanism allows full travel of the shutter 62 within the side tracks 72 and into the housing 90. The arms 66 are generally stored in the retracted position during assembly, shipping, installation and maintenance of the protective shutter 60. The arms 66 are set to the extended position during normal use of the protective shutter 60. When the arms 66 are in the extended position, the end of each of the arms 66 is disposed within the gap 86 and the third channel formed by the walls 74, 76, 78 and fins 82, 84. When the shutter 62 is rolled up toward the housing 90, the arms 66 are engaged by the rubber stop 92, which is in turn engaged by the positioning block 94, to stop the shutter 62 and to retain the bottommost shutter 64 within the side track 72. By using the rubber stop 92 in the stopping mechanism, the arms 66 can repeatedly impact the rubber stop 92 without causing damage to the arms 66, the bottommost slat 64, or any other components of the protective shutter 60. Moreover, the metal-on-rubber impact of the arms 66 and the rubber stops 92 is significantly quieter than the impacts in previous stopping systems. However, as described in the alternative embodiment described above, the metal positioning blocks 94 may be used to engage the arms 66 directly.

Figure 6:
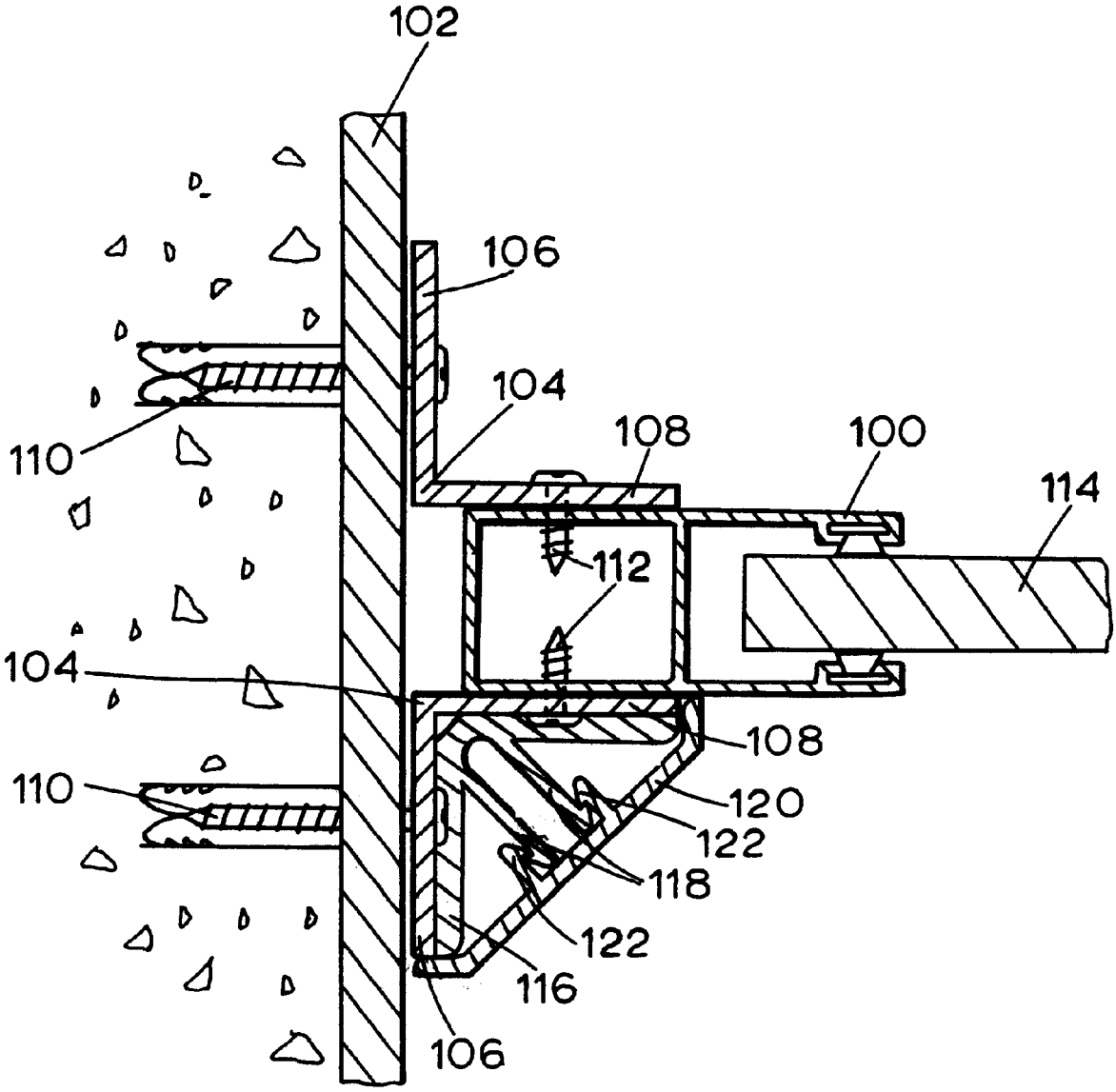
FIG. 6 is a cross-sectional top view of a portion of an angle mounted side track including a cover assembly according to the present invention.

As previously mentioned, an angle mount may be used in applications wherein a protective shutter is mounted between the walls or jambs that define an opening. FIG. 6 illustrates one example of an angle mount including an angle mount cover assembly according to another aspect of the present invention. In the illustrated angle mount, a side track 100 is mounted to a wall 102 using a pair of angle brackets 104 each having a first flange 106 and a second flange 108 oriented perpendicular with respect to the first flange 106. The first flanges 106 of the brackets 104 are mounted to the wall 102 by a plurality of fasteners 110 with the second flanges 108 defining a channel into which the side track 100 is inserted. The side track 100 is disposed between the second flanges 108 and fastened to the second flanges 108 by a plurality of fasteners 112. Once the angle mount is assembled, the side track 100 is ready to receive the slats 114 of the protective shutter.

In one aspect, the present invention includes a cover assembly adapted to hide the brackets 104 and fasteners 110, 112. The cover assembly includes a base 116 that is shaped to fit the contour of an angle bracket 104. The base 116 is fastened to the bracket 104 either with the same fasteners 110, 112 used to mount the bracket 104, with additional fasteners (not shown), or with an adhesive. The base 116 includes a first part of an attachment mechanism in the form of male prongs 118 extending outwardly away from the bracket 104. The cover assembly further includes a cover 120 dimensioned to cover the base 116 and the angle bracket 104 so that only the cover 120 and a portion of the side track 100 are visible. Although the cover 120 shown in FIG. 6 is generally flat, the cover 120 could have any other profile that is aesthetically desirable for a given application, such as square, rounded and the like.

The cover 120 includes a second portion of the attachment mechanism in the form of female prongs 122 extending inwardly toward the bracket 104. The cover 120 is installed onto the base 116 either by sliding the female prongs 122 onto the male prongs 118, or by snapping the female prongs 122 onto the male prongs 118 by applying a compressive force. Other mechanisms for attaching the cover assembly to a bracket 104 and for assembling the base 116 and the cover 120 will be obvious to those of ordinary skill in the art and are contemplated by the inventor as having use with the present invention. For example, the brackets 104 could be fabricated with the male prongs 118 extending therefrom and with the covers 120 attached directly to the brackets 104, thereby eliminating the need for a separate base 116. Alternatively, the base 116 and cover 120 could be fabricated as a single unit and mounted on the bracket 104 using an adhesive.

Other modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A rolling shutter assembly, comprising:

a shutter support member;

a shutter coupled to said shutter support member, said shutter comprising a plurality of individual slats and a plurality of hinges interconnecting said slats, each of said slats having a pair of end portions and one of said slats having an engagement member extending outwardly from one of said end portions;

a pair of shutter tracks, each of said tracks having a U-shaped channel, said shutter and said shutter support member being adapted to roll said shutter from an unrolled position in which said end portions of said slats are disposed in said U-shaped channels to a rolled position in which said shutter is rolled up on said shutter support member, and wherein said engagement member is disposed within said U-shaped channel associated with said one of said end portions; and a stop member disposed in said U-shaped channel associated with said engagement member and proximate said shutter support member;

said stop member being adapted to engage said engagement member to prevent said one of said slats from rolling onto said shutter support member when said shutter is rolled from said unrolled position to said rolled position.

2. An assembly as defined in claim 1, wherein said engagement member is slidably disposed within said one of said slats between an extended position wherein said engagement member is engaged by said stop member and a retracted position wherein said engagement member is not engaged by said stop member thereby permitting said one of said slats to roll onto said shutter support member.

3. An assembly as defined in claim 1, further comprising:

a pair of engagement members extending outwardly from either end portion of said one of said slats; and a pair of stop members, each of said stop members being disposed within one of said U-shaped channels and adapted to engage said engagement member associated with said U-shaped channel.

4. An assembly as defined in claim 1, wherein said stop member is fabricated from a resilient material.

5. An assembly as defined in claim 1, wherein said stop member comprises a rigid member having an adjustment mechanism having a locked position wherein said rigid member is retentively held in a fixed position within said U-shaped channel and an unlocked position wherein said rigid member is slidable within said U-shaped channel.

6. An assembly as defined in claim 5, wherein said stop member further comprises a resilient member disposed below said rigid member in said U-shaped channel and frictionally engaged by said U-shaped channel, said resilient member being adapted to be slidable within said U-shaped channel when said adjustment mechanism is in said unlocked position.

7. A rolling shutter assembly for covering an opening wherein a first wall defines a first side of said opening, comprising:

a shutter support member;

a shutter coupled to said shutter support member;

a pair of shutter tracks, one of said shutter tracks being associated with said wall;

a mounting member being adapted to mount said one of said shutter tracks to said wall;

a base member mounted to said mounting member and having a first coupling member extending outwardly from said base member and away from said mounting member; and a cover member having a second coupling member extending outwardly from a first surface of said cover member and adapted to demountably couple said cover member to said base member when engaged by said first coupling member, said cover member being adapted to substantially completely enclose said mounting member and said base member within said wall, said one of said shutter tracks and said cover member when said second coupling member is engaged by said first coupling member, said shutter and said shutter support member being adapted to roll said shutter from an unrolled position in which said shutter is disposed in said shutter tracks to a rolled position in which said shutter is rolled up on said shutter support member.

8. An assembly as defined in claim 7, wherein said base member is integrally formed with said cover member.

9. An assembly as defined in claim 7, wherein said base member is integrally formed with said mounting member.

10. An assembly as defined in claim 7, wherein said mounting member is mounted to said wall and said shutter track by a plurality of fasteners and said base is mounted to said mounting member by said plurality of fasteners.

11. An assembly as defined in claim 7, wherein said base member is mounted to said mounting member by an adhesive substance.

12. An assembly as defined in claim 7, wherein said cover member has a second surface opposite said first surface and defining a substantially planar surface.

* * * * *